US005784784A

United States Patent [19]

Flanigan et al.

[11] Patent Number: 5,784,784

[45] Date of Patent: Jul. 28, 1998

[54] METHOD OF MAKING A REFRIGERATION COMPRESSOR MUFFLER

[75] Inventors: Paul J. Flanigan, Cicero; Charles E. Ebbing; Thomas S. Katra, both of Fayetteville, all of N.Y.

[73] Assignee: Carrier Corporation, Syracuse, N.Y.

[21] Appl. No.: 753,451

[22] Filed: Nov. 25, 1996

Related U.S. Application Data

[62] Division of Ser. No. 546,250, Oct. 20, 1995.

[51] Int. Cl.[6] ..... B23P 15/00

[52] U.S. Cl. ..... 29/890.08

[58] Field of Search ..... 29/890.08, 890.03, 29/445, 469, 469.5, 506, 508, 520; 181/252, 256, 258, 241, 243, 229, 282, 403

[56] References Cited

U.S. PATENT DOCUMENTS

| | | | |
|---|---|---|---|
| 2,583,366 | 2/1952 | Engels | 181/42 |
| 2,834,425 | 4/1958 | Rawson | 181/42 |
| 3,941,206 | 3/1976 | Halter | 181/50 |
| 4,421,202 | 12/1983 | Hoy | 181/252 |
| 4,834,214 | 5/1989 | Feuling | 181/249 |
| 5,007,499 | 4/1991 | Ebbing et al. | 181/258 |
| 5,101,930 | 4/1992 | Fargo et al. | 181/233 |
| 5,134,846 | 8/1992 | White | 201/890.08 |
| 5,350,888 | 9/1994 | Sager, Jr. et al. | 181/247 |
| 5,398,407 | 3/1995 | Stuer | 29/890.08 |

FOREIGN PATENT DOCUMENTS

| | | |
|---|---|---|
| 2543342 | 9/1984 | France . |
| 1854650 | 7/1962 | Germany . |

*Primary Examiner*—Irene Cuda

[57] ABSTRACT

A muffler including fiberglass packing is assembled and suitable for use in a closed refrigeration system by avoiding the generation of fiberglass debris and preventing its entry into the fluid path. A perforate tube is serially overlain by a heat resistant fabric covering, a fiberglass packing and a circumferentially adjustable and collapsible sleeve which are inserted as a subassembly into the shell of a pressure vessel.

3 Claims, 3 Drawing Sheets

METHOD OF MAKING A REFRIGERATION COMPRESSOR MUFFLER

This application is a division of application Ser. No. 08/546,250, filed Oct. 20, 1995.

BACKGROUND OF THE INVENTION

Mufflers for refrigeration compressors, unlike internal combustion engine mufflers, are in a closed system with the refrigerant gas being, nominally, at compressor discharge temperature and pressure. The new refrigerants must be compressed to higher pressures to achieve the same capacities as the CFC and HCFC refrigerants so that working pressures may be on the order of 400 psi. Accordingly, a refrigeration compressor muffler located in the refrigeration system externally of the compressor is located within a pressure vessel which has requirements of structural integrity well beyond those of an internal combustion engine muffler. This requires structural differences to achieve the higher requirements and presents accompanying changes in manufacture and assembly.

Absorptive mufflers, often called lined ducts, are commonly used in air distribution systems, and occasionally on internal combustion engine exhausts, especially when the objective is to reduce higher frequency noise and pressure pulsations. They have generally not been used in refrigeration systems with positive displacement compressors, even though their acoustic characteristics would appear desirable, because of the special problems presented by the refrigeration system environment. For example: 1) the system is closed and contains many precision components, therefore cleanliness and freedom from debris in the refrigerant stream is essential for proper system operation; 2) the compressor discharge, where the muffler is typically located, is at high pressure and temperature (as high as 400 psi with refrigerants in common use today), therefore the muffler must be located within a pressure vessel; 3) most systems are hermetic, and this is typically achieved by welding and/or brazing the metallic components of the system, including muffler housings, therefore, absorptive materials must withstand the high temperatures involved in assembly without damage; 4) the typical compressor discharge contains large amounts of lubricating oil, which tends to soak the absorptive materials used, the materials must have the appropriate acoustic properties when so soaked, which means materials chosen according to conventional published guidelines will not be effective; 5) many of the new CFC and HCFC replacement refrigerants, and the special oils required to be used with them, are chemically active, and attack many traditionally used absorptive materials; and 6) the flow is severely pulsating and this imposes large dynamic forces on the muffler internals, causing material in conventional configurations to degrade and ultimately disintegrate.

Thus, as compared to conventional absorptive muffler technology, these differences require unconventional material choices, structural differences, and changes in manufacture and assembly techniques.

SUMMARY OF THE INVENTION

Preformed fiberglass packing surrounds the perforated inner tube adapted to be connected to the compressor discharge with a layer of tough, high temperature tolerant woven material between the fiberglass packing and the tube. A thin, sheet metal sleeve surrounds the packing with lapping edges such that the sleeve can be compressed circumferentially. The packing material, such as pre-molded fiberglass with a special binder and density significantly lower than that which conventional prior art would imply, is chemically compatible with the necessary refrigerants and lubricants, while having the needed acoustic properties when soaked with the lubricant. The sleeve has a plurality of circumferentially spaced, axially extending ridges running the majority of its length and extending radially outward from the rest of the sleeve. The ridges are designed in size, number and spacing to provide a desired preload on the fiberglass packing as the sleeve covered assembly is press fit into the outer pressure vessel. The rounded ends of the ridges provide a camming action as the assembly is press fit into place while the ridges provide less surface contact with the interior of the pressure vessel thereby reducing the resistance to the press fit. Because the fiberglass is covered and protected by the sleeve, no fiberglass debris is generated due to scraping the interior of the pressure vessel. Also, the fiberglass is not displaced relative to the inner tube during the press fit.

It is an object of this invention to provide a compression load on the packing material of an acoustic muffler while still providing ease of manufacturing assembly.

It is an additional object of this invention to provide a means for protecting the brittle fiberglass from abrasive damage by the perforated inner tube, both during assembly and during operation with severely pulsating flow.

It is another object of this invention to provide an inexpensive means for providing a compressive preload on fiberglass packing material. These objects, and others as will become apparent hereinafter, are accomplished by the present invention.

Basically, a subassembly is formed of the perforate inner tube, the cloth sleeve, the surrounding fiberglass packing and the preloading sleeve. The preloading sleeve can circumferentially contract and has circumferentially spaced axially extending ridges on the outer surface such that when the subassembly is installed in the pressure vessel via a press fit, the contact between the subassembly and the vessel is limited to the ridges and the inner surface of the vessel.

BRIEF DESCRIPTION OF THE DRAWINGS

For a fuller understanding of the present invention, reference should be made to the following detailed description thereof taken in conjunction with the accompanying drawings wherein.

DESCRIPTION OF THE PREFERRED EMBODIMENT

Figure 1:
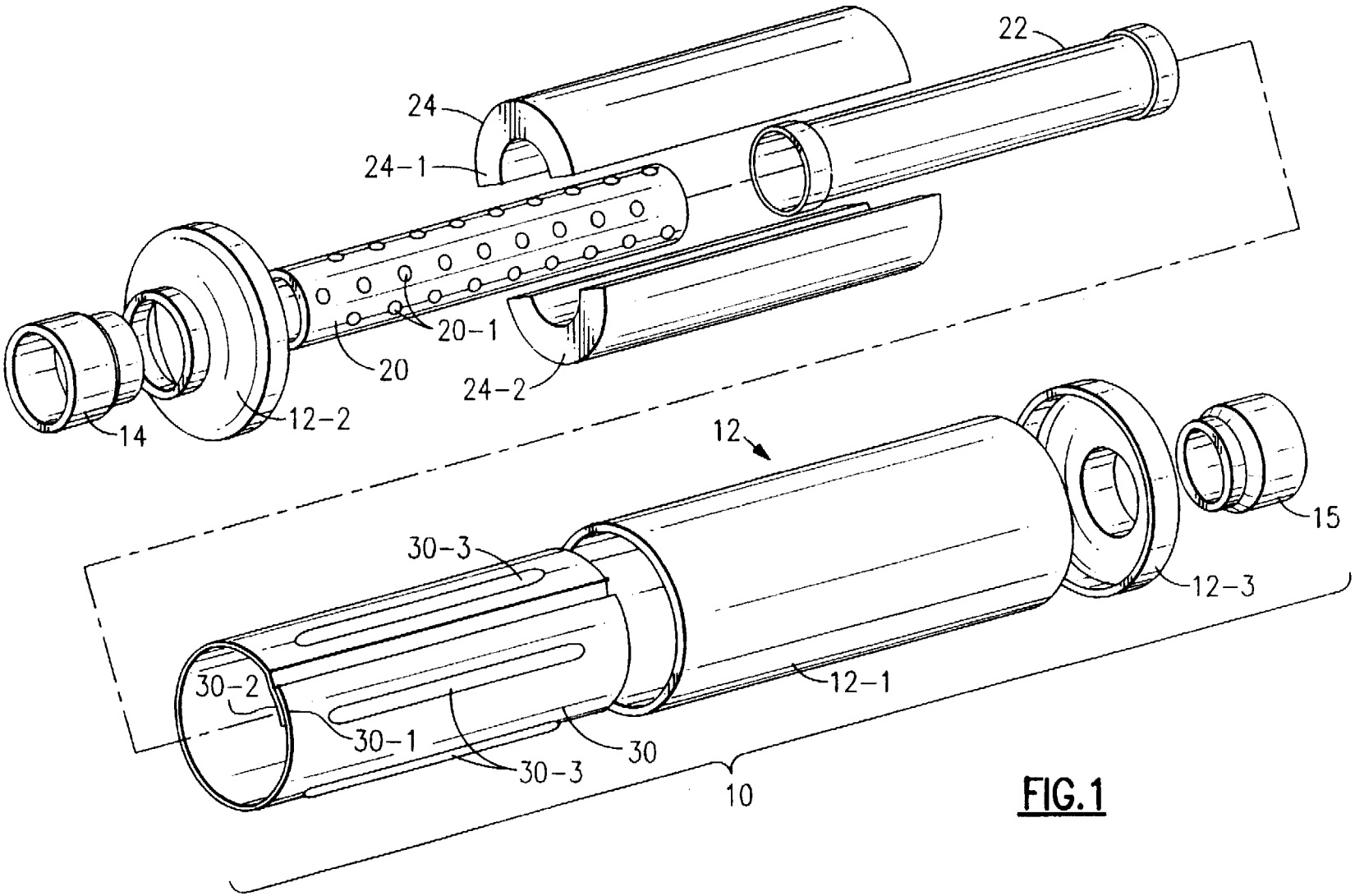
FIG. 1 is an exploded view of the muffler.
Figure 2:
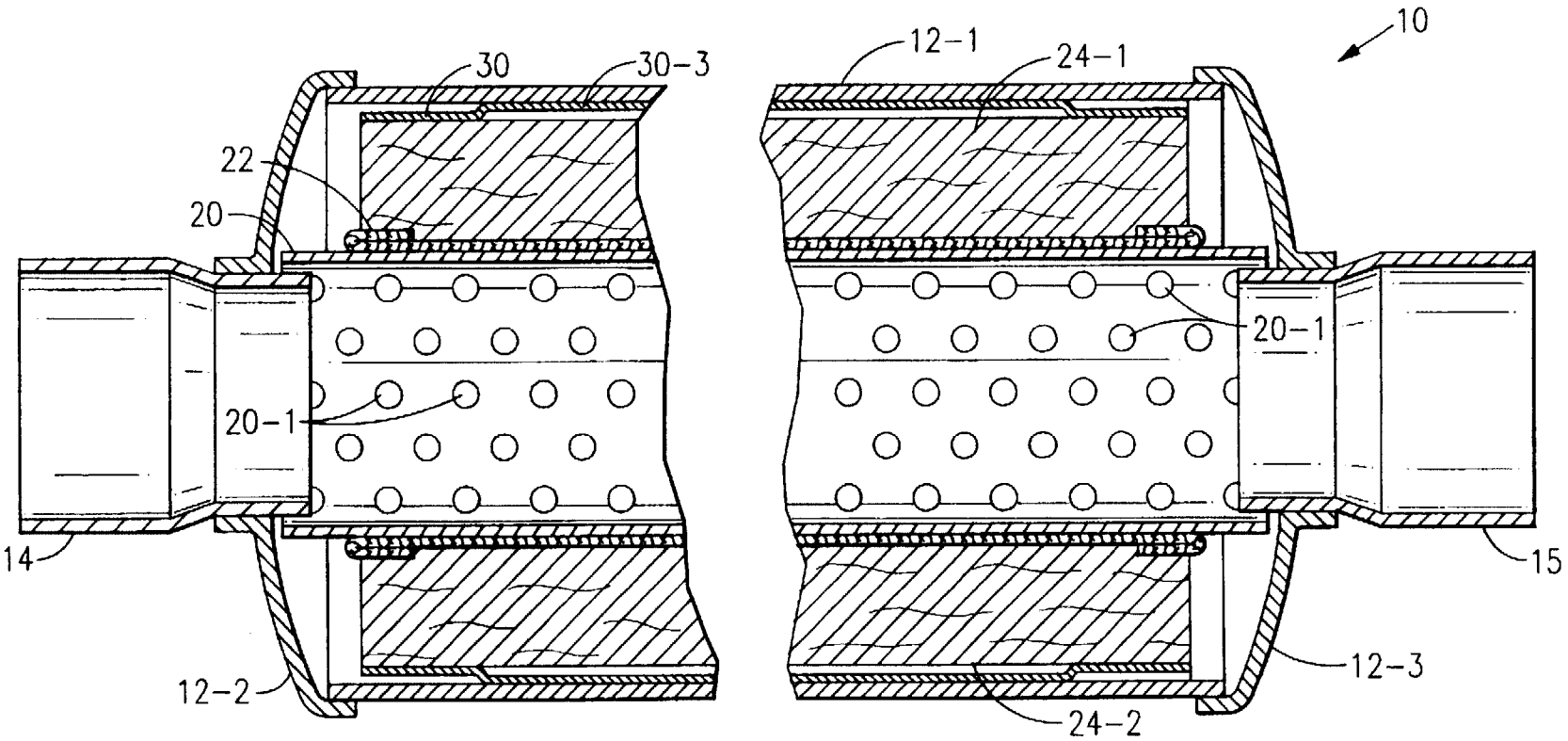
FIG. 2 is a sectional view of the muffler.

In FIGS. 1 and 2 the numeral 10 generally designates a muffler made according to the teachings of the present invention. Muffler 10 includes a pressure vessel 12 made up of shell 12-1 and end caps 12-2 and 12-3 which are welded together in a gas tight seal in the assembled muffler. As is best shown in FIG. 2, end caps 12-2 and 12-3 receive couplings 14 and 15, respectively, which are brazed in place to form subassemblies in the assembly of muffler 10. Perforate tube 20 is located in muffler 10 and includes a plurality of holes 20-1 and nominally 0.125 inches in diameter and providing approximately 40% open space in the wall of tube 20. Tube 20 receives the respective inner ends of couplings 14 and 15 and together therewith defines a fluid path through muffler 10. The outer surface of perforate tube 20 is covered with a material which serves as a filter, primarily to prevent debris from passing into tube 20 and thereby into the closed refrigerant circulation system, as well as protecting the fiberglass from abrasion or the like by the tube 20, particularly by the perforations 20-1. Nomex® cloth which is an aramid fiber material and fire/heat resistant is suitable for sleeve or covering 22 which overlies the outer surface of tube 20. Preferably, covering 22 is hemmed and seamed. Fiberglass with phenolic binder forms the packing which is made in the form of half of an annular cylinder. Cylinder halves 24-1 and 24-2 collectively form packing 24 which is an annular cylinder overlying covering 22.

Figure 3:
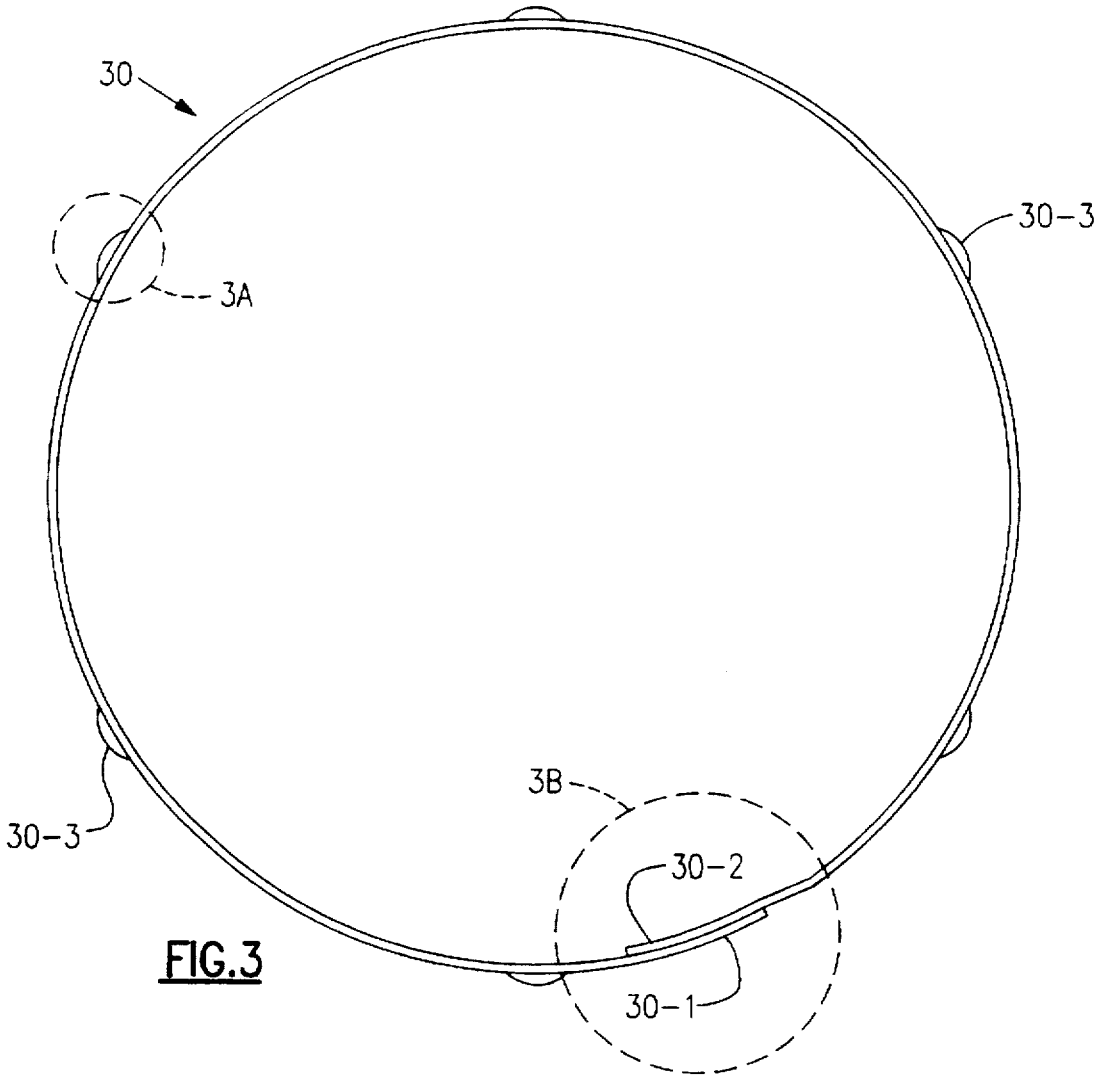
FIG. 3 is an end view of the sleeve.
Figure 3A:
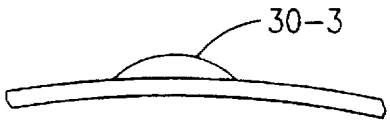
FIGS. 3A and 3B are enlarged views of portions of FIG. 3.
Figure 3B:
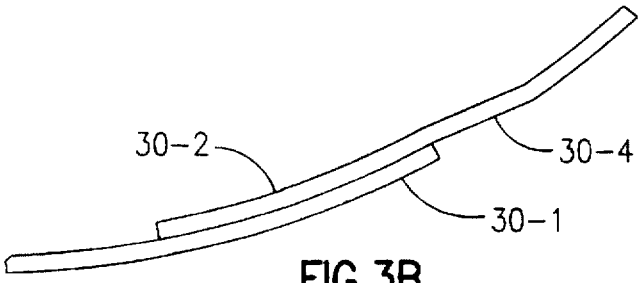

As best shown in FIGS. 3, 3A and 3B, preload sleeve 30 is a thin sheet metal sleeve with evenly circumferentially spaced ridges 30-3 running the majority of its length. Edge 30-1 overlies edge 30-2 to form an overlapped seam with transition 30-4 permitting the overlapped seam and avoiding a circumferential bulge at the overlap. Edges 30-1 and 30-2 can move circumferentially with respect to each other to expand or contract the circumference of sleeve 30. Sleeve 30 has a nominally uniform first diameter with ridges 30-3 effectively defining a second, larger diameter. The free diameter of sleeve 30 is greater than the diameter of the bore of shell 12-1.

In assembling muffler 10, seamed and hemmed covering 22 will be placed over perforate tube 20. Cylinder halves 24-1 and 24-2 which made up fiberglass packing 24 are placed over covering 22 forming a subassembly which is then located in preload sleeve 30. As noted above, preload sleeve 30 is circumferentially adjustable so that it is readily expanded to receive or be placed over the subassembly defined by tube 20, covering 22 and packing 24. With preload sleeve 30 placed over packing 24, the sleeve 30 and the underlying packing 24 are compressed sufficiently to permit insertion of the end of sleeve 30 into shell 12-1 of vessel pressure 12 or, alternatively, to start to place shell 12-1 over sleeve 30. Ridges 30-3 have, effectively, a larger diameter than the rest of sleeve 30 so that further compression of sleeve 30 and packing 24 is required to permit entry of the ridges 30-3. The ridges are designed in size, number and spacing to provide a desired preload on fiberglass packing 24. Additionally, because the ends of the ridges 30-3 are rounded they serve as cams in guiding the sleeve 30 into shell 12-1 while providing less surface area for an easier press fit of sleeve 30 into shell 12-1. It should be readily evident that no fiberglass debris is generated from scraping the outer surface of packing 24 while inserting the sleeve 30 containing packing 24, cover 22 and tube 20 into shell 12-1. Also, the overlapped edges 30-1 and 30-2, while permitting the compression of sleeve 30 to permit its insertion into shell 12-1, additionally, inherently accounts for tolerances in the inner diameter of shell 12-1, the thickness of sleeve 30, the height of ridges 30-3, and the outer diameter of packing 24. At any time the couplings 14 and 15 are brazed into end caps 12-2 and 12-3 respectively and when sleeve 30, packing 24, covering 22 and tube 20 are in place in shell 12-1, end caps 12-2 and 12-3 containing coupling 14 and 15 respectively, are welded in place on shell 12-1 to form pressure vessel 12 and to complete muffler 10. In summary, the present invention permits assembly and use of a muffler employing a fiberglass packing in a closed refrigeration system without generating fiberglass debris or permitting its movement into the closed refrigeration system.

Although a preferred embodiment of the present invention has been described and illustrated, other changes will occur to those skilled in the art. For example, the initial assembly may be made with parts which have a clearance fit but are secured and the fiberglass loaded by the expansion of tube 20. It is therefore intended that the scope of the present invention is to be limited only by the scope of the appended claims.

What is claimed is:

1. A method of assembling a muffler suitable for use in a high pressure, closed circuit comprising the step of:

A) forming a subassembly by taking the serial steps of:

a) placing a heat resistant fabric covering over a perforate tube, b) placing fiberglass packing over said covering, c) locating a circumferentially adjustable preload sleeve over said packing to thereby form the subassembly;

B) circumferentially contracting the sleeve and placing said subassembly in the bore of the shell of a pressure vessel in a force fit; and C) sealing end caps to the shell to thereby complete assembly of said muffler.

2. The method of claim 1 wherein said fabric covering is hemmed and seamed prior to placing over said tube.

3. The method of claim 1 wherein couplings are secured to said end caps prior to securing said end caps to said shell.

* * * * *